US005251766A

United States Patent [19]

Barry

[11] Patent Number: 5,251,766

[45] Date of Patent: Oct. 12, 1993

[54] HOLDER FOR SHEET MATERIAL

[76] Inventor: James A. Barry, 1 Wellfield Cottages, Wellfield Lane, Timperley, Altrincham, Cheshire, England

[21] Appl. No.: 849,204

[22] Filed: Mar. 11, 1992

[51] Int. Cl.[5] ..... A47F 5/08

[52] U.S. Cl. ..... 211/89; 24/67.11; 248/316.3

[58] Field of Search ..... 211/89, 45; 248/316.3, 248/316.2, 316.1; 40/603, 156, 658; 24/67.11, 67.3

[56] References Cited

U.S. PATENT DOCUMENTS

| | | | |
|---|---|---|---|
| 1,768,497 | 6/1930 | Willsea | 211/45 |
| 3,168,954 | 2/1965 | Von Herrmann | 211/89 X |
| 3,399,429 | 9/1968 | Goodman | 248/316.3 X |
| 3,591,013 | 7/1971 | Von Herrmann | 248/316.3 X |
| 3,675,782 | 7/1972 | Dudley | 211/89 X |
| 4,324,337 | 4/1982 | Hermalahti | 248/316.3 X |
| 4,325,484 | 4/1982 | Berry | 211/89 X |

FOREIGN PATENT DOCUMENTS

| | | | |
|---|---|---|---|
| 0029932 | of 1911 | United Kingdom | 211/89 |

*Primary Examiner*—Ramon O. Ramirez
*Attorney, Agent, or Firm*—Nies, Kurz, Bergert & Tamburro

[57] ABSTRACT

A holder for sheet material such as paper, which may be attached to a wall or other surface to serve as a retainer to display notes and the like. The holder comprises an inverted V-shaped elongate member (10) with one vertical leg (11) and one outwardly projecting leg (12). A brush strip (16,17) extends across the slot between the legs to trap the edge region of a sheet (21) of paper or the like introduced into the holder. The holder may be supplied in any suitable length according to its intended use. Sheets of paper introduced into the holder are retained thereby but readily removed when required.

4 Claims, 1 Drawing Sheet

HOLDER FOR SHEET MATERIAL

This invention concerns a holder which may be used to retain one or more sheets of material such as paper, and which may be attached to a wall or other surface to serve as a retainer to display notes and the like. The device is intended to replace similar devices incorporating resilient clips or requiring pins in the case of a notice board.

According to the present invention there is provided a holder for sheet material, comprising an elongate member having a first part for attachment to a surface, a second part projecting from said first part to define a slot, an elongate brush strip attached to said second part and having bristles or the like which extend transversely across said slot to bear against said surface.

Preferably, the first and second parts form an inverted V-shaped elongate member with the brush strip mounted in a recess adjacent the remote edge of one leg of the V and with the bristles extending across the slot defined by the legs to bear upon the opposed surface of the other leg. Adjacent the apex of the V are two or more apertures for receiving screws whereby the device may be attached to a wall or other vertical surface.

Figure 1:
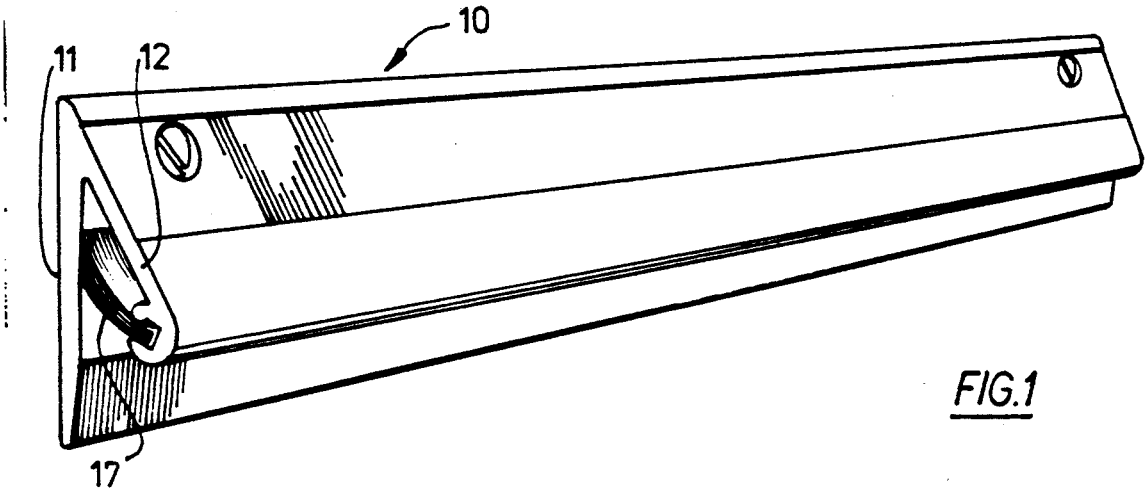
Figure 2:
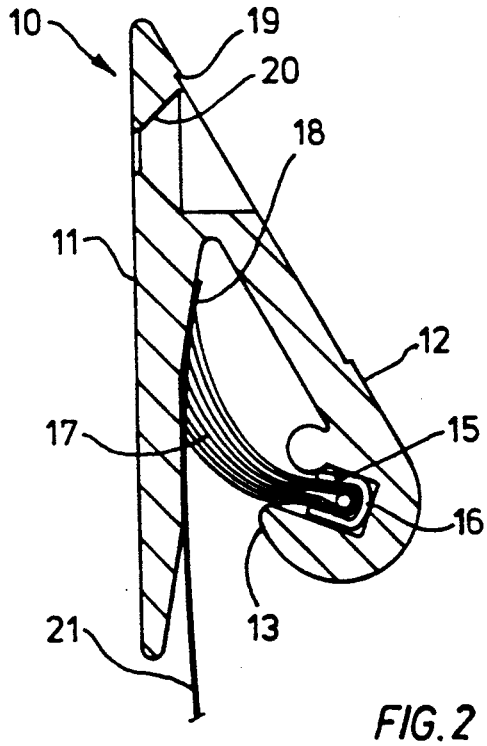

An embodiment of the invention will now be described, by way of example only, with reference to the accompanying drawings in which:

FIG. 1 is a perspective view of a holder made in accordance with the invention; and FIG. 2 is a vertical cross-section through the holder.

Referring now to the drawings, the holder comprises an elongate member 10 of inverted V-shape and comprising a vertical leg 11 and an outwardly projecting inclined leg 12. The holder is preferably made from extruded anodised aluminum.

Referring to FIG. 2 it will be seen that the free end of leg 12 is turned inwardly at 13 to define an inwardly facing elongate recess 15. A brush strip 16 whose length is at least substantially equal to that of the holder 10 is retained within the recess 15 such that the bristles 17 of the strip project inwardly across the slot between the legs 11 and 12 to bear against the opposed inner face of the leg 11.

It will be seen that this face is inclined inwardly at 18 in its upper region towards the inner face of the leg 12. The projecting length of the bristles 17 is greater than the slot between the legs, such that they are deformed upwardly against the inclined face 18.

Along the outer or front face of the leg 12 is a shallow channel 19 to accept an advertising strip or other display medium, and countersunk holes 20 are provided at spaced positions along the holder 10 to receive fixing screws.

In use, a sheet of paper may be introduced upwardly between legs 11 and 12 to be retained by the bristles 17 of the brush strip. The inclined face 18 provides additional grip but the sheet 21 may be removed when required by pulling downwardly.

It is not intended to limit the invention to the above example only. For example, it is conceivable that leg 11 could be omitted so that, with the upper region of leg 12 thickened to receive the fixing screws, the device may comprise a single outwardly projecting leg and brush strip adapted to be screwed directly to a vertical surface so that the bristle tips would bear on the surface itself.

Furthermore, whilst the device is preferably made from aluminium to provide an attractive finish, it may similarly be extruded from plastics.

The brush strip may comprise one or more single strips of resilient material projecting from the recess 15 to bear against the opposed surface.

In construction, the brush strip 16 may be introduced endwise into the recess 15 or transversely if there is sufficient resilience either in the brush strip or in the material of the holder. Again, if required, caps may be provided to conceal the ends of the holder.

It will be appreciated that a holder made in accordance with the invention may be provided in a number of different lengths as required and, with sufficient rigidity of the brush strip, may be adapted to support a screen or curtain along its entire length. There are indeed very many applications for such a device both for domestic and commercial use and the overall dimensions of the device will be selected according to its intended use.

I claim:

1. A holder for sheet material comprising an elongate structure having an upright elongate part adapted for attachment to a surface, a further elongated part attached to and extending at an angle to said upright elongate part and defined between opposed walls thereof a downwardly opening elongate slot for the introduction of a sheet of material; characterized by a portion of said upright elongate part being inclined upwardly and inwardly toward said further elongate part to define a concave portion on said upright elongate part; an inwardly facing elongate recess defined within and extending along said further elongate part; and an elongate brush strip retained within the elongate recess and having bristles of such a length as to extend across the elongate slot and to bear resiliently and be deformed upwardly against the concave portion of said upright elongate part, thus causing a substantially constant holding friction between each of the bristles and said concave portion.

2. A holder for sheet material, according to claim 1, wherein the upright and further elongate parts are integrally formed from extruded anodized aluminum.

3. A holder for sheet material, according to claim 1, wherein an outer surface of said further elongate part includes an outwardly facing shallow recessed channel to accept an advertising strip or other display medium.

4. A holder for sheet material, according to claim 1, wherein the bristles of said brush strip comprise one or more single strips of resilient material projecting from said elongate recess to bear resiliently against the upright elongate part.

* * * * *